US005338285A

United States Patent [19]

Omori

[11] Patent Number: 5,338,285

[45] Date of Patent: Aug. 16, 1994

[54] ROTARY DISCHARGED TYPE CENTRIFUGAL SEPARATOR HAVING A PANTOGRAPH LINK-TYPE SCRAPER

[75] Inventor: Kazuki Omori, Kawasaki, Japan

[73] Assignee: Mitsubishi Kakoki Kaisha Ltd., Tokyo, Japan

[21] Appl. No.: 111,439

[22] Filed: Aug. 25, 1993

[30] Foreign Application Priority Data

Aug. 28, 1992 [JP] Japan ..... 4-253949

[51] Int. Cl.[5] ..... B04B 11/08

[52] U.S. Cl. ..... 494/55; 494/53

[58] Field of Search ..... 494/50-56; 210/372, 374, 375, 380.1, 380.3

[56] References Cited

U.S. PATENT DOCUMENTS

| | | | |
|---|---|---|---|
| 689,571 | 12/1901 | Berrigan | 494/55 X |
| 1,030,974 | 7/1912 | Coppage | 210/375 X |
| 1,065,519 | 6/1913 | Gee | 494/55 |
| 3,098,820 | 7/1963 | Gooch | 494/51 |
| 3,885,734 | 5/1975 | Lee . | |

FOREIGN PATENT DOCUMENTS

| | | | |
|---|---|---|---|
| 4-59065 | 2/1992 | Japan . | |
| 5-76795 | 3/1993 | Japan . | |
| 242829 | 11/1925 | United Kingdom | 210/374 |

*Primary Examiner*—Timothy F. Simone
*Assistant Examiner*—Charles Cooley
*Attorney, Agent, or Firm*—Oblon, Spivak, McClelland, Maier & Neustadt

[57] ABSTRACT

A rotary discharge type centrifugal separator having a long service life, an energy saving effect, high performance and a high mechanical strength in which the length of a revolving cylindrical bowl is reduced; a high revolution is possible; sludge can be separated by a large centrifugal force; and a paste-like solid component can be efficiently discharged. The rotary discharge type centrifugal separator comprises a revolving cylindrical bowl having a separating zone and a scraping section a screw conveyor shaft coaxially and rotatably held in the bowl, and a pantograph link type scraper which is mounted on the screw conveyor shaft at a portion corresponding to the scraping section and which has four link bars pivotally connected to each other in a rhomboidal shape so that the link bars are supported symmetrically in a plane perpendicular to the axial center of the screw conveyor shaft. A scraping plate is attached to a position near the connecting portions of the link bars so as to scrape sludge by the movement of the scraping plates with a small air gap to the guide surface of the revolving cylindrical bowl.

6 Claims, 5 Drawing Sheets

ROTARY DISCHARGED TYPE CENTRIFUGAL SEPARATOR HAVING A PANTOGRAPH LINK-TYPE SCRAPER

BACKGROUND OF THE INVENTION

1. Field of the Invention

The present invention relates to a rotary discharge type centrifugal separator wherein feed slurry containing solids is subjected to a centrifugal force to continuously discharge clarified liquid and sludge separately.

2. Discussion of Background

A conventional scroll discharge type centrifugal separator provided with a helical screw conveyor having a frusto-conical end type scraping section or beach zone for scraping solids has been widely used as a centrifugal separator for separating solids and liquid from feed slurry containing a large amount of solid components.

In such a scroll discharge type centrifugal separator, clarified liquid is moved as an inside layer and sludge is moved as an outside layer in a revolving bowl due to the densities, and the clarified liquid is discharged outside from a large diameter end of the bowl, and the sludge is discharged outside from a small diameter end in a frusto-conical end portion of the revolving bowl.

However, when the conventional centrifugal separator is used for separating solids such as paste-like material, e.g. the separation of solid and liquid from reaction liquid of a biochemical reactor, the separation of suspended solids in fruit juice, the separation of colloidal particles in a fine chemical field and so on, the following disadvantages occur. Namely, in the scraping section or the beach zone of the frusto-conical portion of the scroll type centrifugal separator, sludge is moved in the direction of the small diameter end against a slip force vector along the tapered surface of the beach zone in a vector of centrifugal force. Accordingly, when the gradient of the tapered surface of the beach zone is made large in order to reduce the length of the revolving bowl, the slip force also becomes large in proportion to the increased gradient. When the gradient of the inclined portion is made small to reduce the slip force, the length of the revolving bowl becomes long, whereby it is difficult to rotate it at a high speed, and cost for manufacturing the centrifugal separator is increased.

Further, when solid components in the sludge are of a nature which makes it difficult to cause deformation by a shearing force, the scraping function of the screw conveyor is effectively performed and the solid components can be scraped effectively in the frusto-conical beach zone. However, if the solid component is of a soft and paste-like material such as a product from the biochemical reactor, they leak from the air gap between the revolving bowl and the screw conveyor, or they slip along the helical blade formed on the screw conveyor, whereby an effective scraping function can not be obtained.

In order to eliminate the above-mentioned disadvantage, the inventors of this application have proposed a rotary discharge type centrifugal separator as shown in FIGS. 7 and 8 (Japanese Unexamined Patent Publication No. 59065/1992). Namely, the tapered portion of the revolving bowl is eliminated so that the general shape of the revolving bowl is cylindrical. The conical helical blade of the screw conveyor is also eliminated so that the general shape is in a cylindrical helical blade. The scraping portion is formed in a portion at the sludge discharge side of the revolving bowl., Scrapers extended in the radial direction are mounted on an end portion of the screw conveyor shaft so that the sludge is scraped in the circumferential direction at the inner surface of the revolving bowl.

The proposed centrifugal separator will be described in more detail with reference to FIGS. 7 and 8. In FIG. 7, reference numeral 1 designates a revolving cylindrical bowl supported horizontally. The front and rear ends of the bowl are closed by a front end plate 2 and a rear end plate 3 each provided with a hollowed journal projecting from its center. The revolving cylindrical bowl 1 is defined by a separating zone 1*a* which extends from the front end plate 2 to a portion near the rear end plate 3, and a scraping section 1*b* as the remaining portion which has a slightly larger diameter.

As shown in FIG. 8, a guide member 5 which defines a so-called cocoon-shaped guide surface 4, i.e. the diametrically opposing long portions of an elongated circle are recessed, is fitted to the inner surface of the revolving cylindrical bowl at the scraping section 1*b*. Sludge discharge ports 6 are formed at the recessed portions to penetrate the cylindrical bowl in the radius direction of it. Numeral 7 designates a screw conveyor shaft which is coaxially journaled to the revolving cylindrical bowl 1 by means of front and rear end journals and bearings received in the front and rear end plates 2, 3. A helical blade 9 is formed on the outer surface of a hollowed shaft portion 8 of the screw conveyor shaft 7 so as to extend over the separating zone 1*a*. The outer edge of the helical blade 9 faces, with a small air gap, the inner surface of the separating zone 1*a* of the revolving cylindrical bowl 1. In the scraping section 1*b*, a pair of rectangular scrapers 10 are supported symmetrically in the diametrical direction by respective piston rods which are slidably and outwardly extended in the radial direction, and the outer edge of each of the rectangular scrapers 10 is brought into slide-contact with the cocoon-shaped guide surface 4 of the guide member 5.

Numeral 12 designates a disk-type baffle plate fixed to the screw conveyor shaft 7 at the boundary between the separating zone 1*a* and the scraping section 1*b* so that the outer periphery of the disk-type baffle plate faces the inner surface of the revolving cylindrical bowl with a small air gap. Numeral 15 designates a casing surrounding the revolving cylindrical bowl 1, numeral 16 designates a pair of main bearings for supporting the hollowed journal portions of the front and rear end plates 2, 3 of the revolving cylindrical bowl 1 to the front and rear ends of the casing 15, numeral 17 designates a feed pipe inserted in the hollowed shaft portion 8 of the screw conveyor shaft 7, numeral 18 designates a clarified liquid discharge port formed at the front end of the casing 15 to project downwardly, numeral 19 designates a condensed slurry discharge port formed at the rear end of the casing 15 to project downwardly, numeral 20 designates a motor and numeral 21 designates a reduction gear.

In the above-mentioned centrifugal separator, feed slurry F supplied to the revolving cylindrical bowl 1 through the feed pipe 17 is subjected to centrifugal separation in a usual manner in the separating zone 1*a*, and a liquid component L is discharged as clarified liquid through the clarified liquid discharge port 18. As the liquid component is separated, a solid component S is condensed. The solid component S is moved to the scraping section 1*b* while it is gradually condensed, by means of the helical blade 9 of the screw conveyor shaft 7. The condensed solid component S is forced to enter into the scraping section 1*b* through the air gap between the disk-type baffle plate 12 and the inner surface of the revolving cylindrical bowl 1. In the scraping section 1*b*, the condensed solid component S is scraped to get over a beach zone Z by means of the scrapers 10 which are in slide-contact with the cocoon-shaped guide surface 4, whereby the solid component S is discharged from the sludge discharge port of the revolving bowl.

The conventional centrifugal separator can discharge stably such sludge that solids contained therein is of paste-like soft material. However, it has been found that the scrapers supported by the arms having a piston rod structure has a disadvantage in that it is difficult to obtain a sludge scraping function smoothly for a long period of time because the piston rod structure has a sliding portion, and the scrapers are in slide-contact with the guide surface, whereby there is a large bending moment to the piston rod and there is abrasion and friction loss in the system.

SUMMARY OF THE INVENTION

It is an object of the present invention to provide a rotary discharge type centrifugal separator having high performance, a long service life and an economical advantage, wherein a high speed operation is possible by making the scrapers in free-contact with the guide surface and reducing the length of the revolving cylindrical bowl; sludge can be removed by a high centrifugal force and even a paste-like soft sludge component can be discharged efficiently for a long service term.

The foregoing and other objects of the present invention have been attained by providing a rotary discharge type centrifugal separator comprising a revolving cylindrical bowl, rotatable around its central axis, which has a separating zone extending from an end of the cylindrical bowl to a portion near the other end and a scraping section defined in the remaining portion, and which has end plates having a central opening to close the both ends of the cylindrical bowl, and a hollowed screw conveyor shaft, coaxially extended in the revolving cylindrical bowl and rotatable therein at a small differential speed, which has a helical blade on the outer surface of the shaft in the area corresponding to the separating zone so that the outer edge of the helical blade faces the inner surface of the revolving cylindrical bowl, wherein feed slurry is fed through the feed pipe placed in the hollowed portion of the screw conveyor shaft to the separating zone of the revolving cylindrical bowl so that clarified liquid is taken out from an end portion of the separating zone and sludge is discharged through a discharge port in the scraping section with scrapers which are urged outwardly in the radial direction by a centrifugal force, wherein a rhomboid pantograph link type scraper device comprises four link bars having the same length which are pivotally connected to each other in a rhomboidal shape and the scraping device is mounted on the screw conveyor shaft in the scraping section in a coaxial manner wherein a rectangular scraping plate is outwardly extended from each of the pivotally connected portions, and a drive control means which is attached to one of the end plates of the revolving cylindrical bowl to control symmetrical expansion and contraction movements of the rhomboid pantograph link type scraper device in the diametrical direction of the revolving cylindrical bowl during the revolution so that the top of the scraping plates depicts a parallel closed curve while a small air gap remains between the top and a guide surface formed in the inner surface of the revolving cylindrical bowl.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
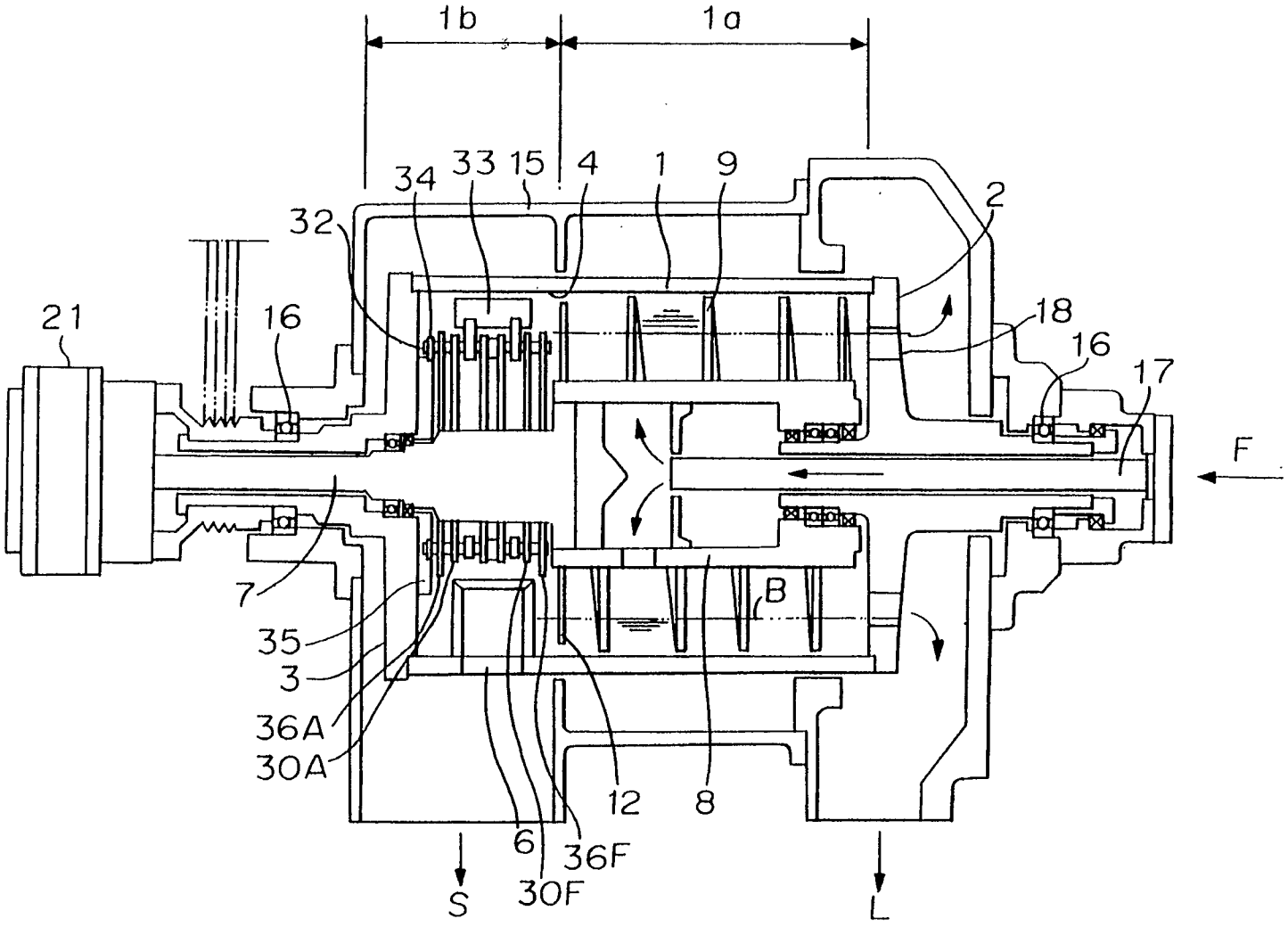
FIG. 1 is a longitudinal cross-sectional view of an embodiment of the rotary discharge type centrifugal separator according to the present invention.
Figure 2:
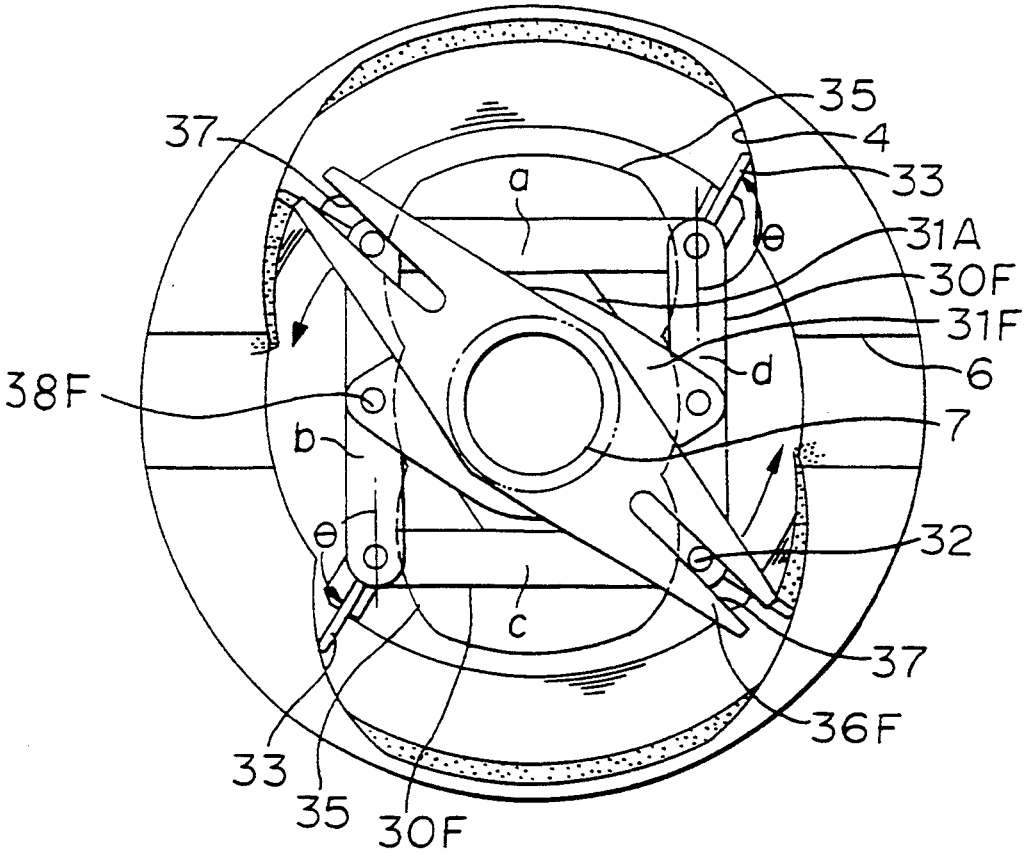
FIG. 2 is a cross-sectional view of a scraping section in FIG. 1.
Figure 3:
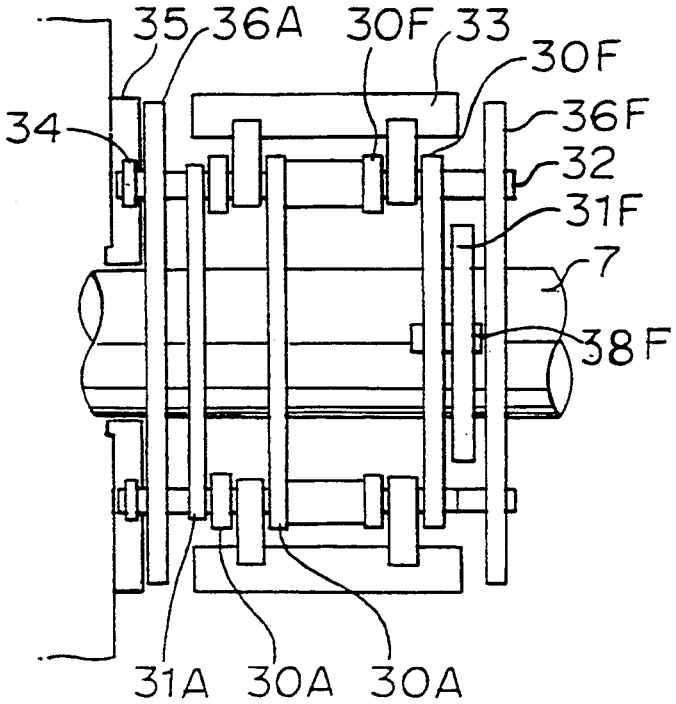
FIG. 3 is a side view of the scraping section shown in FIG. 2.

Preferred embodiments of the rotary discharge type centrifugal separator of the present invention will be described with reference to FIGS. 1 through 6 wherein the same reference numerals as in FIGS. 7 and 8 designate the same or corresponding parts, and accordingly, description of these parts is omitted.

Figure 7:
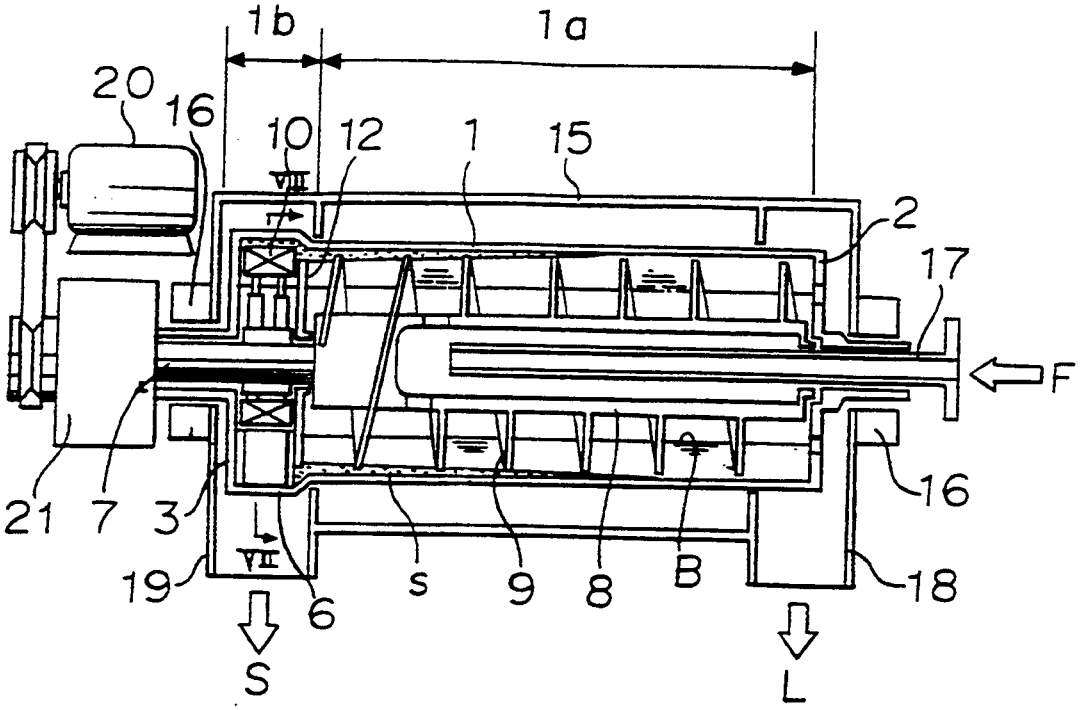
FIGURE 7 (PRIOR ART)
FIG. 7 is a longitudinal cross-sectional view of the conventional centrifugal separator proposed in Japanese Unexamined Patent Publication No. 59065/1992.
Figure 8:
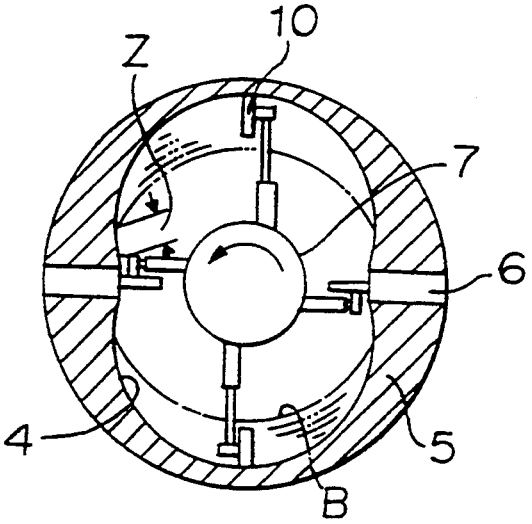
FIGURE 8 (PRIOR ART)
FIG. 8 is a cross-sectional view viewed from an arrow mark VII—VII in FIG. 7.

In short, the characteristic feature of the present invention in comparison with the conventional structure disclosed in FIGS. 7 and 8 resides in that a scraper plate is supported at a position near each connecting portion of link bars of a rhomboid pantograph link assembly which is capable of expanding and contracting, and the expanding and contracting movements of the rhomboidal pantograph link assembly are controlled by a cam plate having a contour of a symmetric closed curve, whereby the outer periphery of the scraping plates can be moved without any contact and with a small air gap along a cocoon-shaped guide surface formed in a scraping section.

In FIGS. 1 through 5, a double rhomboid pantograph link type mechanism 30 is mounted on the screw conveyor shaft 7 in the scraping section of the revolving cylindrical bowl 1. The double rhomboid pantograph link type mechanism 30 comprises a front pantograph 30F and a rear pantograph 30A each comprising four link bars having the same length, wherein the link bars are connected to each other at their both end portions to form a rhomboid shape. A front support arm 31F is supported rotatably at its central opening by the screw conveyor shaft 7, and the front support arm 31F pivotally supports with respective pins 38F the midpoints or neutral points of a pair of opposing link bars of the front pantograph 30F. A rear support arm 31A is supported rotatably at its central opening by the screw conveyor shaft 7, and it pivotally supports with pins the midpoints or neutral points of a pair of opposing link bars of the rear pantograph 30A. Four scraper supporting shafts 32 pivotally support the connecting portions of the link bars of the front and rear pantographs 30F and 30A. Each of the scraper supporting shafts 32 support a scraping plate 33, and a roller 34 is pivotally connected to the rear end of each of the scraper supporting shafts 32. Each of the scraping plates 33 has a rectangular shape, which is fixed to the scraper supporting shaft 32 by means of a pair of arms to have an angle $\theta$ to the longitudinal axis of link bars a, b, c and d of the front or rear pantographs 30A, 30F.

A cam plate 35 having a profile of an elongated circular closed curve, e.g. an athletic track shape or an approximately oval shape, is fixed to the inner surface of the rear end plate of the revolving cylindrical bowl 1 in a coaxial manner. The rollers 34 pivotally supported by the rear end of the scraper plate supporting shafts 32 are in roll-contact with the outer circumference of the cam plate 35. Numerals 36F and 36A designate front and rear driving yokes each having guide grooves 37 at both ends, each groove extending in the radial direction with respect to the central opening. The front and rear driving yokes 36F and 36A are respectively fixed to the rear and front end portions of an intermediate diameter portion of the screw conveyor shaft 7 at their central opening. Both end portions of each of the scraper plate supporting shafts 32 are pivotally fitted to each of the guide grooves 37.

In the above-mentioned embodiment, when the screw conveyor shaft 7 and the revolving cylindrical bowl 1 are relatively rotated, the double rhomboid pantograph link type mechanism 30 is rotated by means of the driving yokes 36F and 36A fixed to the screw conveyor shaft 7. In the rotating movement of the pantograph mechanism 30, the position of the outer periphery of the scraping plates 33 connected near the connecting portions of the link bars of the pantographs is determined by the position of the pivotal pins at both ends of the support arms 31F, 31A and the relative position of the scraping plate supporting shafts 32 to the cam plate 35.

Figure 4:
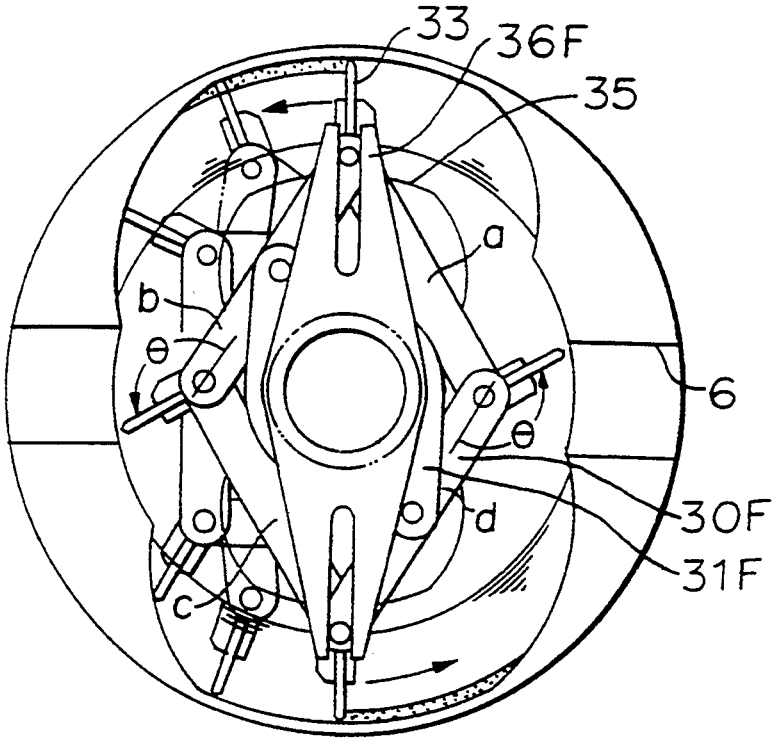
FIG. 4 is a cross-sectional view of the scraping section in FIG. 2 which shows the rotating movement of scrapers.
Figure 5:
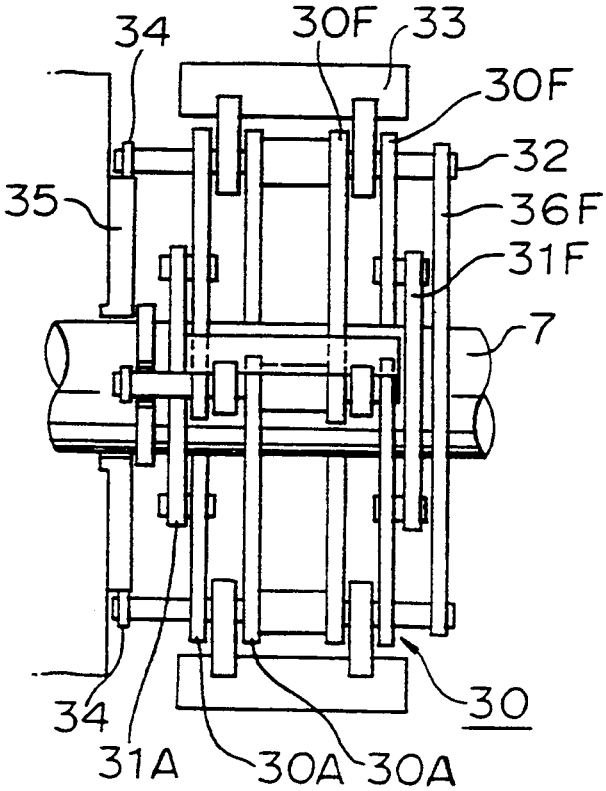
FIG. 5 is a side view partly broken of the scraping section shown in FIG. 4.

A case of using the cam plate 35 having the profile of an athletic track shape is described, for instance. As shown in FIG. 4, the front driving yoke 36F indicates a direction of 12 o'clock-6 o'clock. Then, when the screw conveyor shaft 7 is rotated in the counterclockwise direction, the scraping plates 33 are also rotated in the same direction. When the screw conveyor shaft 7 is further rotated, the front and rear pantographs 30F, 30A assume a square shape. Then, the pantographs are returned to the original posture shown in FIG. 4. During the above-mentioned operations, the outer periphery of the scraping plate draws a generally cocoon-shaped locus wherein the opposing sides of an elongated circle are more or less bulged out. The profile of the cam plate and the locus of the outer periphery of the scraping plates are in such relation that when either one is determined, the other follows in response to that. Accordingly, by suitably selecting the profile of the cam plate so that the outer periphery of the scraping plates draws a predetermined locus, the outer periphery of the scraping plates can be moved without any contact while maintaining a small air gap such as about 1.0 mm along the guide surface 4 of the scraping section of the revolving cylindrical bowl 1.

Figure 6:
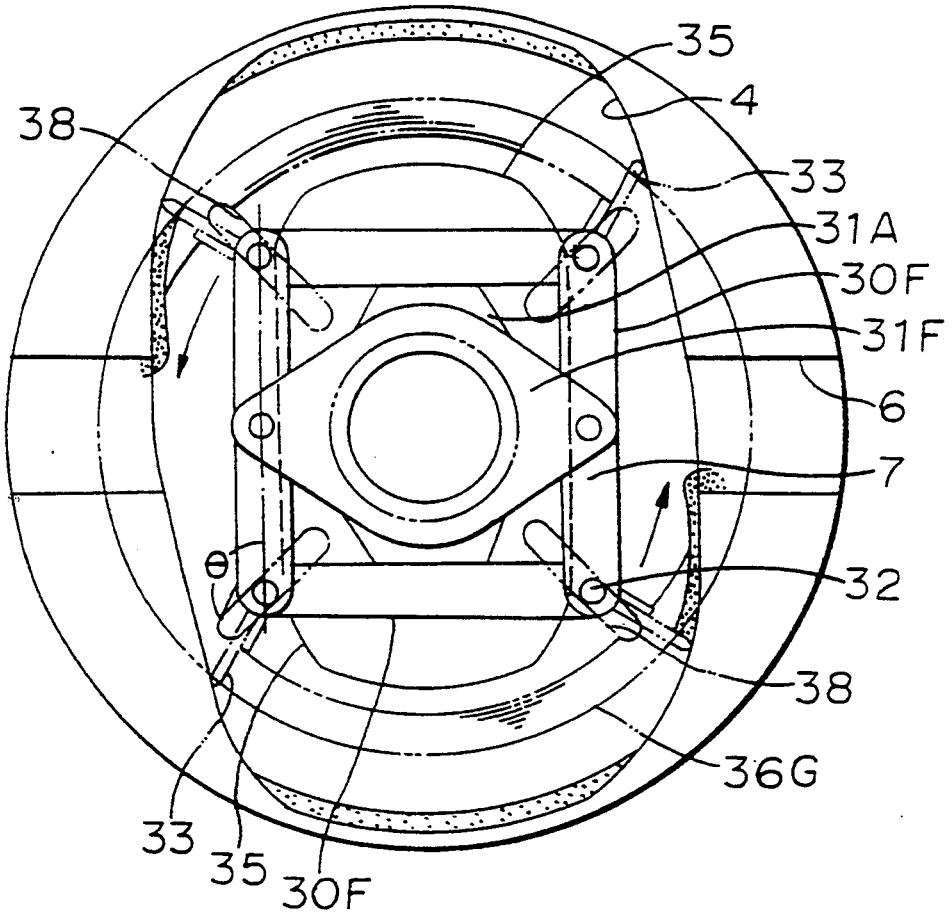
FIG. 6 is a cross-sectional view showing another embodiment of the scraping section of the present invention.

FIG. 6 is another embodiment of the front and rear driving yokes. In this embodiment, the driving yokes are respectively made of a circular plate 36G each having four guide grooves 38 in which both ends of the scraping plate supporting shafts 32 are pivotally supported. The circular driving yokes 36G can prevent sludge from squeezing out from the gap between each side of the scraping plates 33 and the inner surface of the driving yokes. The embodiment shown in FIG. 6 is suitably used for a large-sized centrifugal separator having a revolving cylindrical bowl of a large diameter.

In the above-mentioned embodiments, the locus of the outer periphery of the scraping plates is controlled by the profile of the cam plate. However, the present invention is not limited thereto, and another controlling means such as a rail may be used.

Thus, in the operations of the rotary discharge type centrifugal separator of the present invention, clarified liquid can be separated in the same manner as a scroll discharge type centrifugal separator by the action of a centrifugal force in a revolving bowl which is rotated at a high speed wherein sludge is condensed as the clarified liquid is separated while it is moved toward a scraping section by the rotation of a screw conveyor shaft, and the sludge is moved from the separating zone to the scraping section in the revolving bowl while the condensation of the sludge progresses.

In the scraping section, the scrapers mounted on the screw conveyor shaft which is rotated at a relatively low speed with respect to the revolving bowl are moved in a non-contacting state while leaving a small gap along the cocoon-shaped guide surface which has a beach zone in the scraping section whereby the sludge, in particular solids contained therein are scraped beyond the beach zone so that the scraped solids are discharged outside through the discharge port formed in the radial direction of the scraping section.

The scrapers used are of a simple structure, which withstand scraping operations without causing wearing and breaking for a long time. In particular, since the scrapers rotate without any contact to the guide surface of the scraping section, there is little wearing of the scrapers. Further, since the scrapers are driven in a state that the driving yokes pivotally hold the scraper plate connecting pins, a revolution of constant speed can be obtained.

In a case that a baffle plate is provided at the boundary between the separating zone and the scraping section, a relatively soft solid component can be effectively separated because the baffle plate can predominantly introduce condensed sludge into the scraping section and effectively scrapes the condensed sludge in association with the scrapers.

In accordance with the rotary discharge type centrifugal separator having the construction and function described above, the following effects are obtainable and is very useful in an industrial field.

(1) Since the revolving bowl is in a cylindrical shape having a tapered portion, the entire length can be reduced, whereby the weight is reduced and manufacture is easy, with the result that manufacturing cost can be reduced and revolution speed can be increased to improve a centrifugal effect.

(2) Sludge can be continuously and stably discharged, and sludge having high concentration can be treated.

(3) Control of discharging of sludge can be conducted easily by adjusting the differential speed between the revolving bowl and the screw conveyor shaft.

(4) Even though a paste-type solid material is treated, sludge can be discharged stably by means of the scrapers.

(5) Since the scrapers are supported by the rhomboid type pantograph link mechanism which comprises four link bars supported by the support arm, they have a sufficient mechanical strength. Further, since the scrapers can be moved in a non-contact state to the guide surface, there is no abrasion and frictional loss, whereby a highly efficient centrifugal operation is obtainable for a long time.

(6) The cam plate and the guiding members can be easily removed to form a beach zone suitably for sludge to be treated.

Obviously, numerous modifications and variations of the present invention are possible in light of the above teachings. It is therefore to be understood that within the scope of the appended claims, the invention may be practiced otherwise than as specifically described herein.

What is claimed is:

1. A rotary discharge type centrifugal separator, comprising:

a revolving cylindrical bowl having a central axis, said cylindrical bowl being rotatable around said central axis, said cylindrical bowl comprising a separating zone defined by a portion of the cylindrical bowl which extends from a first end of the cylindrical bowl to a position of the cylindrical bowl near a second end of the cylindrical bowl, and a scraping section substantially defined by a remaining portion of the cylindrical bowl, said cylindrical bowl further comprising said plates positioned at said first and second ends of the cylindrical bowl to close said first and second ends of the cylindrical bowl, and a hollowed screw conveyor shaft which coaxially extends in the revolving cylindrical bowl and is rotatable therein at a small differential speed, said hollowed screw conveyor shaft comprising a helical blade on an outer surface of the screw conveyor shaft in an area corresponding to said separating zone, wherein an outer edge of said helical blade faces an inner surface of the revolving cylindrical bowl, and feed slurry is fed through a hollowed portion of the hollowed screw conveyor shaft to said separating zone of the revolving cylindrical bowl so that clarified liquid is taken out from an end portion of the separating zone;

scraping means rotatably positioned in said scraping section for discharging sludge through a discharge port in the scraping section, said scraping means being outwardly urged in a radial direction by a centrifugal force, said scraping means comprising a rhomboid pantograph link type scraper device comprising four link bars having the same length, said four link bars being pivotally connected to each other at pivot portions in a rhomboidal shape, said scraper device being mounted on the screw conveyor shaft in the scraping section in a coaxial manner, and a rectangular scraping plate outwardly extends from the scraper device from a position near each of the pivot portions; and drive control means attached to one of said end plates of the revolving cylindrical bowl for controlling symmetrical expansion and contraction movements of said rhomboid pantograph link type scraper device in a diametrical direction of the revolving cylindrical bowl during revolution so that a top of the scraping plates substantially define a closed curve during said revolution, wherein a small air gap is defined between said top of the scraping plates and a guide surface in the inner surface of the revolving cylindrical bowl.

2. The rotary discharge type centrifugal separator according to claim 1, wherein the rhomboid pantograph link type scraper comprises a support arm which is rotatably held by the screw conveyor shaft by inserting the screw conveyor shaft in an opening formed at a center of the support arm, said support arm having first and second ends which pivotally support midpoints of opposing link bars of said four link bars of the rhomboid pantograph link type scraper so that diagonal lines connecting opposing ones of said pivot portions of the rhomboidal pantograph link type scrape can be expanded and contracted.

3. The rotary discharge type centrifugal separator according to claim 1, wherein the drive control means comprises a cam plate having an approximately oval shape, said rhomboid pantograph link type scraper comprising a driving yoke operatively connected to the screw conveyor shaft, and rollers which roll on an outer circumference of the cam plate in response to rotation of said driving yoke.

4. The rotary discharge type centrifugal separator according to claim 3, wherein the driving yoke is of an elongated bar type, a center of said driving yoke being secured to the screw conveyor shaft, and the driving yoke having forked portions at both ends of the driving yoke to hold opposing pivot portions of said pivot portions of the link bars of the rhomboid pantograph link type scraper device.

5. The rotary discharge type centrifugal separator according to claim 3, wherein the driving yoke is a circular plate, a center of said driving yoke being secured to the screw conveyor shaft, said driving yoke comprising four guide grooves in which the pivot portions of the link bars of the rhomboid pantograph link type scraper device are held.

6. The rotary discharge type centrifugal separator according to claim 1, wherein the rhomboid pantograph link type scraper device comprises scraper portions, each of said scraper supporting shafts supporting a single scraping plate.

* * * * *